United States Patent [19]

Vöhringer

[11] Patent Number: 4,970,100

[45] Date of Patent: Nov. 13, 1990

[54] FABRIC FOR PAPERMAKING MACHINES

[75] Inventor: Fritz Vöhringer, Heidenheim, Fed. Rep. of Germany

[73] Assignee: F. Oberdorfer GmbH & Co. KG Industriegewebe-Technik, Fed. Rep. of Germany

[21] Appl. No.: 373,325

[22] Filed: Jun. 28, 1989

[30] Foreign Application Priority Data

Jul. 18, 1988 [DE] Fed. Rep. of Germany ..... 3824324

[51] Int. Cl.[5] ..... B32B 5/12

[52] U.S. Cl. ..... 428/105; 428/107; 428/109; 428/224; 428/284; 428/288

[58] Field of Search ..... 428/105, 107, 109, 284, 428/288, 224

[56] References Cited

U.S. PATENT DOCUMENTS 4,490,427 12/1984 Grant et al. ..... 428/107

4,724,183 2/1988 Human ..... 428/259

*Primary Examiner*—James J. Bell

*Attorney, Agent, or Firm*—Gifford, Groh, Sprinkle, Patmore and Anderson

[57] ABSTRACT

The invention concerns a fabric for use in papermaking machines as the forming wire as well as for the basic fabric for the coated, impermeable bands and belts for extended nip presses and for forming roll coatings. A fabric of such a kind will be provided such that its stability in cross direction is increased, its resistance against unravelling even at high service pressures existing in the press nip of extended nip presses is increased and its abrasive resistance is improved. These objects are attained by the fact that at least a part of the longitudinal threads and/or cross threads of the fabric consist of a mixed polymer the main components thereof are a polymer having a high molecular weight corresponding to a viscosity of at least 0.75 as well as a copolymer with a high molecular weight corresponding to a viscosity of at least 0.80, wherein the percentage of the copolymer within the mixed polymer is 2% to 20%.

14 Claims, No Drawings

FABRIC FOR PAPERMAKING MACHINES

The invention relates to a fabric for papermaking machines as forming wire as well as basic fabrics for coated, impermeable bands and belts for the use in extended nip presses and as coatings of forming rolls.

BACKGROUND OF THE INVENTION

Papermaking fabrics, forming wires, webs or fabrics for coated, impermeable bands and belts for extended nip presses and fabrics for forming roll coatings have to fulfill extremely strong requirements. Therefor, for the manufacturing of such fabrics and webs only specific materials can be used which fulfill these requirements.

Thus, fabrics for forming wires are manufactured of polymeric monofiles using for the longitudinal threads exclusively polyester-monofiles, because only with that kind of monofile the required stability in longitudinal direction can be gained. As under operation longitudinal stresses of more than 200 N/cm. width of the wire may occur, the essentially abrasion resistant or wear resistant polyamide, for instance, cannot be used as material for the longitudinal threads, because this material is too highly stretching, so that such kind of wires would not have the required stretching or elastic stability.

On the other hand pure polyester wires, i.e. forming wires in which the cross threads, too, consist of polyester monofiles have no sufficient life time, because polyester has in comparison to polyamide an essentially lower abrasive resistance, so that the operational time of those wires is much too short in order to use these wires as useful alternative. This drawback is also not balanced by the fact that pure polyester wires having the known common double layered binding require as shown by tests an energy input which is in comparison to the so called mixed wires of the same kind, consisting of polyester as well as also of polyamide, by about 30% smaller.

Moreover, it was found out that wires the cross threads thereof consist exclusively of polyamide are not sufficiently stable in cross direction because of the low configurational resistance at the high water absorption, causing bulging of the monofiles. This deficiency results therein that such wires on running on the paper machine form pleats.

DESCRIPTION OF THE PRIOR ART

Because of the above mentioned deficiencies German published application DE-OS No. 25 02 466 proposes to use only for a part of the cross threads polyamide monofiles, whereas the remaining cross threads should consist of polyester. By those so called mixed or alternating weft wires in many cases the life time, i.e. the operationally useful duration of the use of the wire until its replacement or maintenance, could essentially be extended.

Until today the basic fabrics or wires for coated and liquid-impermeable bands or belts for extended nip presses are manufactured of polyamide threads. Such belts are fed over a concave shoe and are pressed into that shoe by a roll positioned thereabove. Between the shoe and the roll run at least one felt web as well as the paper web which is to be pressed and therefore to be dewatered. By the press nip which is in such a way extended the drying degree of the paper web is essentially increased. Because of the high surface pression within the press nip the monofiles of the basic wire of the band or belt must fulfill high requirements with respect to persistancy of their fibers. These requirements are doubtlessly fulfilled by polyamide monofiles; it must, however, be recognized that the above mentioned small configurational stability of polyamide monofiles often results therein that in case of an impair pressure distribution over the width bubbles arise within the band or belt as well as changements with respect to its circumference, especially elongations. These effects result therein that the fabric is submitted in this area to an increased fullingwork and is therefore quickly destroyed.

It is true, that this effects may be avoided by the use of polyester monofiles, these monofiles, however, are for such a purpose not sufficiently resistant against unravelling.

It is well known that the surface of the forming rolls of papermaking machines is configured as a honeycombed grating construction. This surface serving as contact area is, however, much too coarse structured for a fine wire and would therefore quickly destroy the wire by the usual wire speeds of about 1000 m/min and more. Thus, between the wire and the forming roll surface a tubelike coating of a stable fabric is positioned, preferrably in linen-binding, and having a mesh number of about 16/cm$^2$. This so called forming roll coating is shrink-fitted with the aid of heat onto the roll. In order to reach a strong fit of the coating on the forming roll surface sufficient shrinkage capability on temperatures of about 100° to 130° C. and a corresponding high shrinkage force are required. Such a coating must fulfill essential requirements with respect to the abrasive resistance and the resistance against unravelling. The strong fit could until now be reached only by coatings consisting of polyester monofiles. This material, however, is, as mentioned above, not essentially abrasive resistant and resistant against unravelling so that the operation times and life times of such rolls or their coatings, respectively, could not satisfy.

SUMMARY OF THE PRESENT INVENTION

Therefore, it is the object underlying the invention to provide a wire of the above mentioned kind which does not have the explained drawbacks, occurring on using known monofiles, and which guarantee a universal application in the limits of the stated possibilities of use.

It is a further object of the invention to provide a wire of the above mentioned kind which fulfills especially in economical aspects multiple requests.

This object is attained according to the subject invention by the features that at least part of the longitudinal threads and/or cross threads of the fabric consist of a mixed polymere, the main components thereof are a polymere with a high molecular weight corresponding to a viscosity of at least 0.75, as well as with a copolymere having a high molecular weight, corresponding to a viscosity of at least 0.80, wherein the percentage of the copolymere within the mixed polymere is 2 to 20%.

In this way the increase of power input which is caused by the use of cross threads of polyamide on the running side of papermaking wires, also named forming wires, can be avoided, if instead of polyamide monofiles on the running side of the wire mixed polymere monofiles are interwoven. Diminishing of power input, however, means saving energy. An essential decrease of the operation- or running time or life time, as is inherent to pure polyester cannot be found in connection with the wire of the subject invention. Because of the chemical resistance against acids wires of mixed polymeres according to the invention may successively be used in those cases, where polyamide cannot be used because of its known sensitiveness to acids. Because mixed polymeres have a higher resistance against abrasion and unravelling, even an essential increase of the life time may be reached. In fine forming wires and essentially in those which contain on the paper side additionally fine fill wefts, so called floating threads, the use of mixed polymere monofiles as floating threads is essentially advantagous, because in the past the fine floating threads, the diameters of which are usually 0.13 mm and smaller, have often been destroyed during cleaning the wires.

The reason therefore is the fact that the cleaning water which is fed through high pressure splash tubes onto the wire surface damages by its impact energy not only the sensitive floating threads. The damages by unravelling observed on the known polyester monofiles will not be found on mixed polymere monofiles or are ocurring thereon only under heavy exceeded splash- or spray pressures. Therefore, the splash water pressures which are in the past at about 30 bar can be increased in connection with the wires according to the subject invention in order to make wire cleaning more effective.

In coated, liquid impermeable belts for extended nip presses of papermaking machines the use of mixed polymere monofiles and mixed polymere multifiles within the basic fabric results in essential advantages with respect to the characteristics of these belts and bands, because the material according to the subject invention attaining the stability and configurational resistance of polyester, is with respect to the abrasive resistance superior to polyester and with respect to the resistance against unravelling even superior to polyamide. Therefore, this material is suited ideally as basic fabric for press belts giving the possibility to replace the polyamide threads as necessary in the past by the material according to the subject invention.

Tests have revealed the fact that the fabric or material, respectively, of the subject invention fulfills highest requirements concerning the configurational and unravelling stability. The elongation or stretching in axial direction of a belt for extended nip presses consisting of the material according to the invention is by at least 50% less than that of the known belts having the same binding in their basic fabric, woven, however, of polyamide monofiles. Because the papermaking machine must be put out of operation, if the tension of the belt in axial direction is to be adjusted, the small axial elongation means a decrease of the operation stops because of such adjustments and therefore a better utilization of the machine in operational aspects. For press bands or press belts, respectively, having a water store volume provided by the weave extending beyond the coating or by portions of that weave, the configurational stability in case of high pressure loads is essentially important. Also in those cases the fabric according to the subject invention as basic web or fabric is much superior to a polyamide fabric or web.

Forming roll coatings manufactured of fabrics according to the invention develope in case of a sufficient shrinkage even at temperature of about 100° C. to 130° C. shrinking forces which are about twice or even a multiple higher than in corresponding polyamide fabrics. Therefore, in contrast to the polyamide fabric a more secure and stronger fit of the forming roll coatings is attained. The resistance against unravelling of the fabric according to the invention is not only higher than that of a polyamide coating, but it is even by a multiple higher than that of a polyester coating of the quality as used in the past.

A further advantage of the fabric according to the invention should be seen therein that swelling of the mixed polymere threads is excluded by the absorption of water in contrast to polyamide threads. According to an advantageous embodiment of the subject invention, the percentage of the copolymere can be between 5% and 10%, using as polymere polyethylene-terephtalate and as copolymere dimethyl-isophtalat or polybutylene-terephtalate. The viscosity of the polymere may be usefully adjusted to at least 0.85 and that of the copolymere to at least 1.0.

In those cases, in which the fabric according to the invention is used as papermaking fabric it has been found essentially advantageous as one layered web or double layered web, wherein the cross threads are manufactured of the above mentioned mixed polymere.

In case the fabric according to the invention is used as coated, impermeable band or corresponding belt for the extended nip press for a papermaking machine the fabric is used as one layered basic or inforcing web, wherein at least the longitudinal threads are manufactured of the above mentioned mixed polymere. This is also true in case the fabric according to the invention is configured for the indicated application as a double layered web.

In case of use of the fabric according to the invention for forming roll coatings it has been found advantageous to have a one layered fabric in which the longitudinal threads as well as the cross threads are manufactured of the above mentioned mixed polymere.

The above mentioned term "longitudinal direction" means "papermachine direction" and "cross direction" means "cross machine direction".

I claim:

1. A fabric for use as a forming wire in papermaking machines, said fabric comprising a plurality of longitudinally extending threads and a plurality of cross-wise extending threads, at least one of said plurality of longitudinally and cross-wise extending threads being formed of a mixture of polymer and copolymer, said copolymer being in the range of 2% to 20% of said mixture and having a high molecular weight with a viscosity of at least 0.80, said polymer having a high molecular weight with a viscosity of at least 0.75.

2. The fabric according to claim 1, wherein said percentage of said copolymer is in a range between 5% and 10%.

3. The fabric according to claim 1 wherein said polymer is polyethylene-terephthalate having a viscosity of at least 0.85 and said copolymer is dimethyl-isophthalate having a viscosity of at least 1.0.

4. The fabric according to claim 1, wherein said polymer is polyethylene-terephthalate having a viscosity of at least 0.85 and said copolymer is polybutylene-terephthalate having a viscosity of at least 1.0.

5. The fabric according to claim 1, said fabric comprising a single layered web and having said plurality of cross-wise extending threads formed of said mixture.

6. The fabric according to claim 1, said fabric comprising a double layered web and having said plurality of cross-wise extending threads formed of said mixture.

7. A fabric for use as a base wire for forming coated, impermeable bands and belts for extended nip presses and for forming roll coatings, said fabric comprising: a plurality of longitudinally extending threads and a plurality of cross-wise extending threads, at least one of said plurality of threads being formed of a mixture of a polymer having a high molecular weight with a viscosity of at least 0.75 and a copolymer having a high molecular weight with a viscosity of at least 0.80, said mixture having a percentage of copolymer in the range of 2% to 20%.

8. The fabric according to claim 7, wherein said percentage of said copolymer is in a range between 5% and 10%.

9. The fabric according to claim 7, wherein said polymer is polyethylene-terephthalate and said copolymer is dimethyl-isophthalate having a viscosity of at least 1.0.

10. The fabric according to claim 7, wherein said polymer is polyethylene-terephthalate having a viscosity of at least 0.85 and said copolymer is polybutylene-terephthalate having a viscosity of at least 1.0.

11. The fabric according to claim 7, said fabric comprising a single layered web and having said plurality of cross-wise extending threads formed of said mixture.

12. The fabric according to claim 7, said fabric comprising a double layered web and having said plurality of cross-wise extending threads formed of said mixture.

13. The fabric according to claim 7, said fabric comprising a single layered web, said web having said plurality of longitudinally extending wires formed of said mixture.

14. The fabric according to claim 7, said fabric comprising a double layered web, said web having said plurality of longitudinally extending wires formed of said mixture.

* * * * *